US010615506B1

(12) United States Patent
Feng et al.

(10) Patent No.: US 10,615,506 B1
(45) Date of Patent: Apr. 7, 2020

(54) OPTICALLY CONTROLLED REFLECT PHASED ARRAY BASED ON PHOTOSENSITIVE REACTIVE ELEMENTS

(71) Applicants: Simin Feng, Oxnard, CA (US); Kevin A. Boulais, La Plata, MD (US); Walter D. Sessions, Marietta, GA (US); Pearl Rayms-Keller, Fredericksburg, VA (US); Robert B. Nichols, Yorktown, VA (US); William F. Smith, King George, VA (US); Karen J. Long, Upper Marlboro, MD (US); Michael S. Lowry, Fredericksburg, VA (US)

(72) Inventors: Simin Feng, Oxnard, CA (US); Kevin A. Boulais, La Plata, MD (US); Walter D. Sessions, Marietta, GA (US); Pearl Rayms-Keller, Fredericksburg, VA (US); Robert B. Nichols, Yorktown, VA (US); William F. Smith, King George, VA (US); Karen J. Long, Upper Marlboro, MD (US); Michael S. Lowry, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 106 days.

(21) Appl. No.: 15/641,657

(22) Filed: Jul. 5, 2017

(51) Int. Cl.

| | |
|---|---|
| ***H01Q 3/46*** | (2006.01) |
| ***H01Q 15/00*** | (2006.01) |
| ***H01Q 15/14*** | (2006.01) |
| ***H01Q 3/26*** | (2006.01) |

(52) U.S. Cl.
CPC ..... *H01Q 15/0066* (2013.01); *H01Q 3/2676* (2013.01); *H01Q 3/46* (2013.01); *H01Q 15/0086* (2013.01); *H01Q 15/142* (2013.01); *H01Q 15/148* (2013.01)

(58) Field of Classification Search
CPC .... H01G 15/0066; H01G 3/2676; H01G 3/46; H01G 15/142; H01G 15/148
See application file for complete search history.

(56) References Cited

U.S. PATENT DOCUMENTS

| | | | | |
|---|---|---|---|---|
| 6,396,449 | B1 | 5/2002 | Osterhues et al. | 343/754 |
| 6,469,677 | B1 | 10/2002 | Schaffner et al. | 343/876 |
| 6,806,792 | B2 | 10/2004 | Penn | 333/164 |
| 7,307,596 | B1 | 12/2007 | West | 343/778 |
| 7,315,225 | B2 | 1/2008 | Borysenko | 333/164 |

(Continued)

OTHER PUBLICATIONS

A. J. Fenn et al.: "The Development of Phased-Array Radar Technology", *Lincoln Lab. J.* 12(2), 2000. http://citeseerx.ist.psu.edu/viewdoc/download:jsessionid=A7AC267027A69E11F5F6717A9619C628?doi=10.1.1.73.2849&rep=rep1&type=pdf.

(Continued)

*Primary Examiner* — Graham P Smith
(74) *Attorney, Agent, or Firm* — Gerhard W. Thielman

(57) ABSTRACT

A control device is provided for photonic switching. The device includes an optically tunable metamaterial unit cell. This structure includes a dielectric substrate; at least two arrays of metamaterial elements located on the top surface thereof, the metamaterial being capable of reflecting electromagnetic radiation, and a layer of photo-capacitive material overlapping the at least two arrays of metamaterial elements, the photo-capacitance of the photo-capacitive material being optically tunable; and a reflectarray or phased array system containing the unit cell.

9 Claims, 3 Drawing Sheets

(56) References Cited

U.S. PATENT DOCUMENTS

| | | | | |
|---|---|---|---|---|
| 7,525,500 | B2 | 4/2009 | Lee | 343/771 |
| 7,907,100 | B2 | 3/2011 | Mortazawi et al. | 343/853 |
| 7,969,359 | B2 | 6/2011 | Krishnaswamy et al. | 342/372 |
| 8,009,114 | B2 | 8/2011 | Hauhe et al. | 343/754 |
| 8,044,866 | B2 | 10/2011 | Weaver | 343/701 |
| 8,223,423 | B2 | 7/2012 | Haberfelde et al. | 359/263 |
| 8,405,562 | B2 | 3/2013 | Rice | 343/721 |
| 8,649,742 | B2 | 2/2014 | Maruyama et al. | 455/106 |
| 9,515,390 | B1 | 12/2016 | Feng et al. | H01Q 15/148 |

OTHER PUBLICATIONS

D. G. Berry et al.: "The Reflectoarray Antenna", *IEEE Trans. on Antennas & Propagation* 11, 645-651, 1963. https://ieeexplore.ieee.org/stamp/stamp.jsp?arnumber=1138112.

K. A. Boulais et al.: "Tunable Split-ring Resonator for Metamaterials . . . ", *Appl. Phys. Lett.* 93, 043518, 2008. https://aip.scitation.org/doi/pdf/10.1063/1.2967192.

OPTICALLY CONTROLLED REFLECT PHASED ARRAY BASED ON PHOTOSENSITIVE REACTIVE ELEMENTS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to electronic switches using light actuated control. In particular, the invention relates to using metamaterial switches using metamaterial for switch actuation.

Reflectarrays are known to those skilled in the art of antenna designs as useful for reflecting an electromagnetic wave at various angles by electrically controlling the phase of the elements that make up the array. A phased array can be used to control the direction of electromagnetic waves. Usually the array elements are progressively phased with a uniform amplitude excitation.

By controlling the phase of individual radiators within the array, a narrow electromagnetic beam with well-defined direction can be formed. By dynamically changing the relative phase and amplitude in ways known to those skilled in the art of antenna phased array design, the beam can be steered. See: A. J. Fenn, D. H. Temme, W. P. Delaney, and W. E. Courtney "The Development of Phased-Array Radar Technology," *LINCOLN Laboratory Journal,* 12, 321 (2000); and D. G. Berry, R. G. Malech, and W. A. Kennedy, "The Reflectarray Antenna", *IEEE Transactions on Antennas and Propagation* 11, 645 (1963) into different directions. Often, the elements are designed to radiate at a given frequency or over a range of frequencies.

Phase shifters are electrically controlled and can be expensive due to the complicated electronic circuits required thereby. Each antenna array is often composed of hundreds or thousands of phase shifters. These types of devices can be affected by electromagnetic interference (EMI) between the many shifters. EMI often complicates the designs and increases costs of manufacture and operation.

A metamaterial is a metallic or semiconductor substance whose properties depend on engineered structures at the sub-wavelength scale rather than on the composition of the atoms themselves. Certain metamaterials bend visible light rays in the opposite sense from traditional refractive media K. A. Boulais et al. "Tunable split-ring resonator for metamaterials using photo-capacitance of semi-insulating GaAs" *Applied Physics Letters* 93, 043518 (2008). Photo-capacitors respond to variation in light intensity primarily, but also to variation in light frequency, by changing their capacitance.

SUMMARY

Conventional switching devices yield disadvantages addressed by various exemplary embodiments of the present invention. In particular, exemplary embodiments provide a control device for photonic switching. The device includes an optically tunable metamaterial unit cell. This structure includes a dielectric substrate; at least two arrays of metamaterial elements located on the top surface thereof, the metamaterial being capable of reflecting electromagnetic radiation, and a layer of photo-capacitive material overlapping the at least two arrays of metamaterial elements, the photo-capacitance of the photo-capacitive material being optically tunable; and a reflectarray or phased array system containing the unit cell.

Exemplary embodiments provide techniques for dynamically deflecting, shaping, and steering an electromagnetic beam with a low cost reflector or phased array antenna by optically tuning metamaterial elements employing photo-capacitor elements. One embodiment of the invention relates to an optically tunable metamaterial unit cell comprising a dielectric substrate having a top surface and a bottom surface; at least two arrays of metamaterial elements located on the top surface of the dielectric substrate, the metamaterial being capable of reflecting electromagnetic radiation, and a layer of photo-capacitive material overlapping the at least two arrays of metamaterial elements, the photo-capacitance of the photo-capacitive material being optically tunable.

Another embodiment of the invention concerns a reflectarray system comprising at least one of the above-described optically tunable metamaterial unit cells. A still further embodiment of the invention comprises a phased array system comprising at least one of the above-described optically tunable metamaterial unit cells. An additional embodiment relates to a method for controlling a phase shift of an incoming electromagnetic signal in an antenna comprising: providing a reflect-array or phased array antenna having a plurality of the above-described optically tunable metamaterial unit cells, and adjusting the phase shift of the electromagnetic signal by optically tuning at least some of the photo-capacitive material.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims. This disclosure incorporates by reference in its entirety U.S. Pat. No. 9,515,390 assigned Navy Case 102705.

Figure 1:
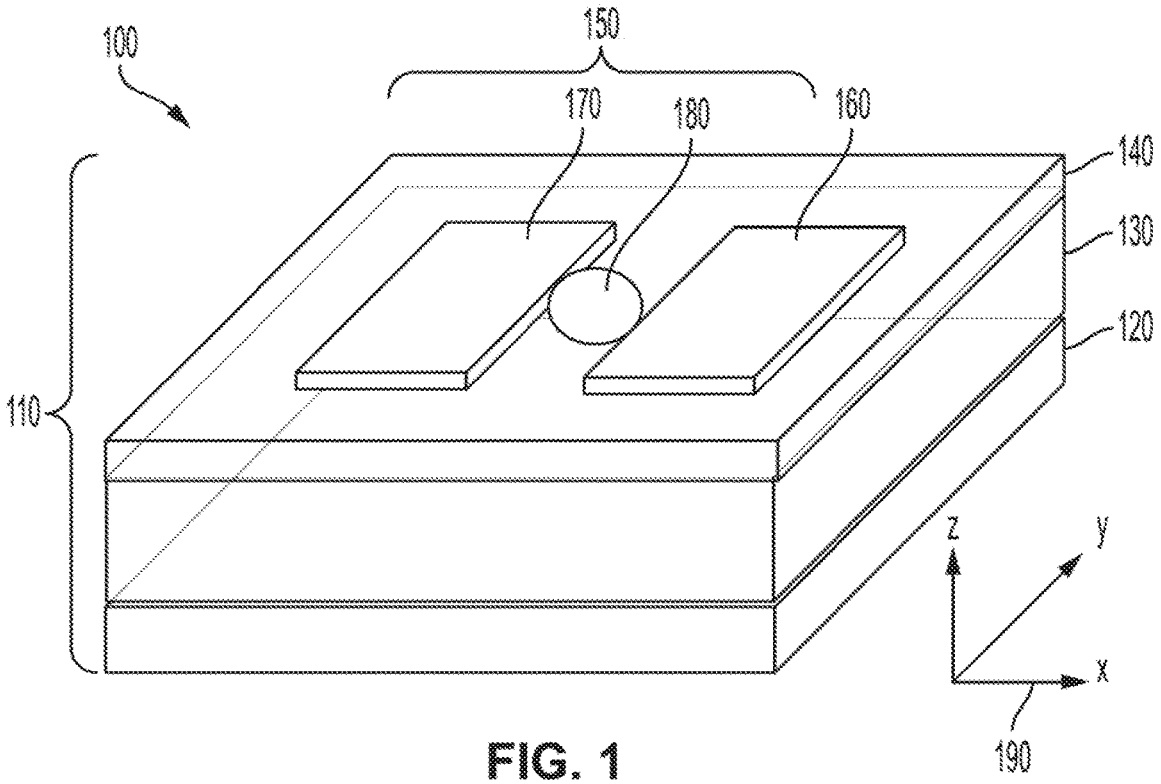
FIG. 1 is a elevation view of a photo-capacitive cell.

FIG. 1 shows an isometric view 100 showing a portion of a photonic control device for switching via light. The view 100 illustrates structural detail of an exemplary unit cell 110 of a grid of phased-array reflector cells. The cell's structure includes a substrate that denotes a conductive backplane 120 composed of a conductive metal, for example copper (Cu), gold (Au), silver (Ag), aluminum (Al). A dielectric layer 130 can be formed by various materials. FR-4 constitutes one such material for the dielectric layer 130, being a glass-reinforced laminate epoxy, which is low cost but lossy at high frequencies. Alternatively, a polymer could be used for the dielectric layer 130. For optical tuning, a light-guide film 140 is disposed over the dielectric layer 130.

Figure 2:
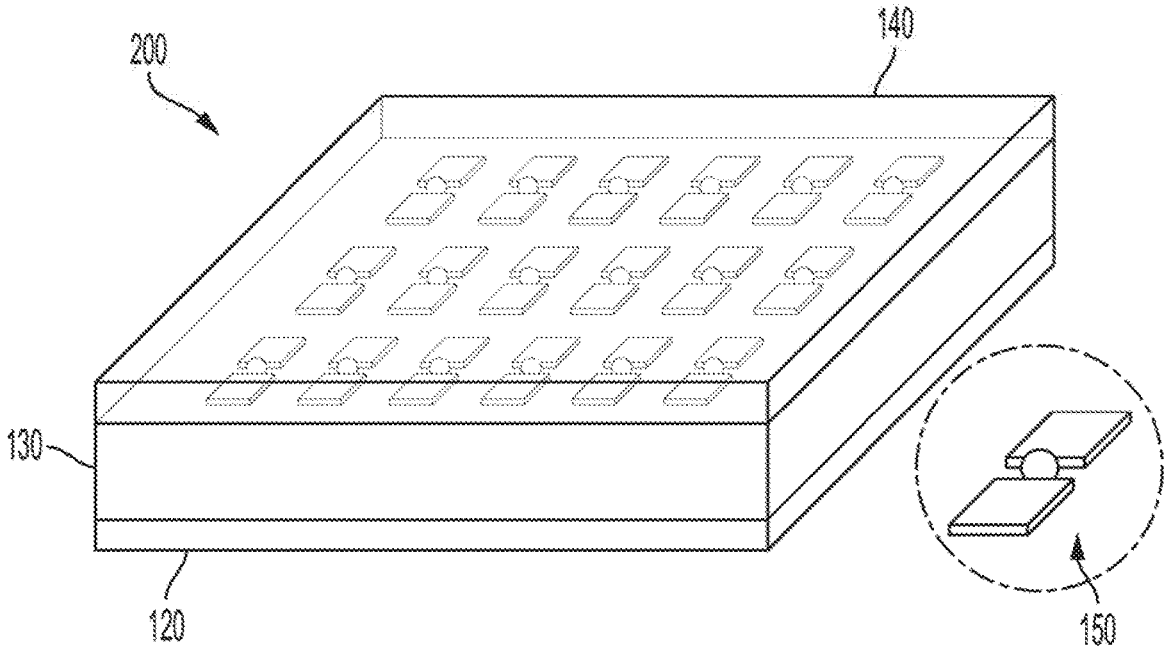
FIG. 2 is a graphical view of a photo-capacitive array of cells.

The film 140 includes disposed thereon a meta-material element 150 (or meta-atom) that comprises first and second (i.e., right-and-left) patch elements 160 and 170 joined together by a switch element 180. A compass rose 190 shows Cartesian coordinates for the x (horizontal), y (lateral) and z (thickness) directions. FIG. 2 shows an isometric view 200 of a planar reflector array composed of a grid of repeated unit cells 110 in the x and y directions to form a planar reflector array whose normal is the z direction.

That switch element 180 can be formed from photo-capacitive ink. Alternatively, the switch element 180 can be based on any of electric, optical, thermal, piezo, liquid crystal, phase transition material and micro-electromagnetic system (MEMS) configurations The switch element 180 controls the state of the unit cell 110, each of which has a pair of phase states. The design of the unit cell 110 represents only one of many types that can be implemented. Other designs include but are not limited to cross structures, pad structures, mushroom structures in which a via connects some locations on the meta-atom 150 to the ground backplane 120, or inverses of the structures in which the non-metallic regions and metallic regions are reversed.

As described in further detail, the sub-wavelength periodic array in view 200 of meta-material elements 150 are deposited over the dielectric layer 130, which can also serve as an absorption layer when the cell 110 is used as reflector array or on a non-absorption layer when used as phased array antenna). A switch element 180 of a photo-capacitive material ink or any type of single-crystal photosensitive material is printed in the gaps between patch elements 160 and 170. The light guide film 140 is disposed either over (as shown) or under the dielectric layer 130. The metallic backplane 120 may be positioned below the dielectric layer 130. The cell structure may comprise multilayers, i.e., light guide films 140 interleaved with metamaterial elements 150.

Each metamaterial element 150 is preferably ultrathin and composed of a subwavelength periodic array of metallic elements deposited on the dielectric layer 130. Each meta-material element 150 is bridged by a nanocomposite material that forms the switch element 180, whose capacitance can be tuned by light (herein referred as photo-capacitive ink). The dielectric layer 130 is absorptive when the device is used as a passive reflector array for beam deflection and steering.

For active phased array antenna usage, the dielectric layer 130 should be low or non-absorptive and the antenna receives signals by techniques to those skilled in the art of antenna designs. For clarity, rectangular metallic patches 150 and 160 connected by switch elements 180 are shown to represent the meta-atoms 150. However, artisans of ordinary skill will recognize that the shape of the metallic elements is immaterial, provided that the metallic elements can strongly reflect the electromagnetic waves.

Exemplary embodiments exhibit the advantage of controlling the phase with simple two-stage elements. Phase resolution depends on the number of elements, while dynamic range in phase depends on the phase difference of the two states. Therefore, the resolution and the dynamic range can be independently controlled. A side lobe exists because the system basically represents a two-element reflect-array where each element has different phases and amplitudes that can be controlled through, but not limited to, photo-capacitors with different light intensities. Alternatively, one could use a microstrip semiconductor p-i-n diode phase shifter (with the high-level injection diode denoting positive-region, intrinsic-charge-carrying-type, negative-region). Side lobes can be minimized by controlling amplitude of the reflector elements similarly to conventional techniques with phased arrays.

Exemplary embodiments are predicated on the realization that photosensitive materials such as photo-capacitor materials function as phase-tuning elements when positioned between and overlapping meta-material elements. Exemplary embodiments can also be used to achieve two-beam reflection. Moreover, the reflector array can also function as a phased array antenna to radiate electromagnetic waves in the optically controlled direction. By varying the optical power, the capacitance of the photo-capacitive material, for example, can be changed, which, in turn, modifies the reflection phase of the electromagnetic wave incident on the meta-atoms. Artisans of ordinary skill will recognize that the embodiments described herein are applicable to multi-layered arrays.

The advantage of the exemplary process and instruments, compared to conventional electric control arrangements, include low cost, elimination of electrical wires, and mitigation of electromagnetic interference (EMI) effects, which can be devastating for device operations. A suitable photo-capacitive paint may comprise a pigment based ink for the switch element 180 fabricated from pulverized semi-insulating materials.

The printing technology and the meta-material layer, which can be manufactured with common lithography techniques, renders the exemplary technique more affordable than conventional solutions available on the market. The optical power is easily controlled through, for example, a well-designed light-guide film, an array of optical fiber channels or fiber fabric niched on the meta-material elements. The exemplary phased array described herein does not suffer from the EMI effect, is of a significantly simpler design and reduces costs over conventional versions.

Figure 3:
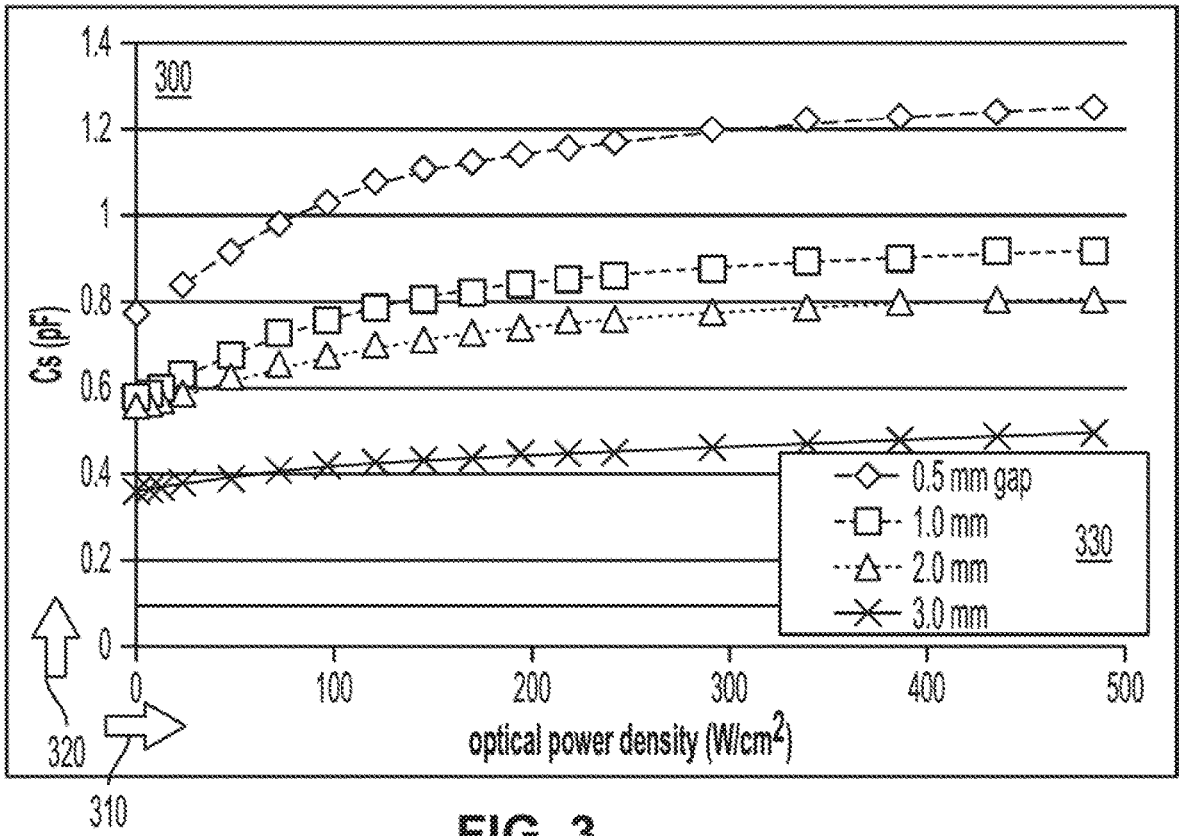
FIG. 3 is a graphical view of changing of capacitance with optical power density for different gap width between the two metallic patches in each unit cell.

FIG. 3 shows a graphical view 300 of the effect on capacitance from optical power density as the abscissa 310 in watts-per-square-centimeter ($W/cm^2$). The capacitance in picofarads (pF) constitutes the ordinate 320, and the legend 330 identifies the patch gaps as lines marked by diamonds (0.5 mm), squares (1.0 mm), triangles (2.0 mm) and diagonal crosses (3.0 mm). The trends show asymptotic rising towards a constant value, with capacitance decreasing with gap size. Other light delivery methods may also be used, for example, an array of optical fiber channels or fiber fabric niched on the switch elements 180. The absorption layer underneath the reflective elements is used to reduce the side lobe from unwanted specular reflection.

Therefore, the dominant direction of reflected beam can be fully controlled by the phased elements by optically tuning the capacitance of each meta-atom 150. The photo-capacitive ink for the switch elements 180 is based on pulverized undoped semi-insulating gallium arsenide (GaAs) pigment. The change of the capacitance is a function of the optical power, gap width, meta-atoms, substrate, and the compositions of the photo-capacitive ink. To deflect or dynamically steer the beam, requires a progressive linear phase shift along the meta-material elements 150.

The phase shift can be implemented in two manners. One way is varying the geometric and material parameters of individual meta-material elements 150 and using a uniform light-guide film 140. The other way is progressively varying the scattering centers of the light-guide film 140 along the elements and keeping the meta-atoms invariant. For proper designs, when tuning the optical power the changing of the capacitance imparts a linear phase shift on the wavefront of the electromagnetic field incident upon the meta-material elements 150 resulting in a tilted wavefront. This deflects the beam into a new direction.

The principle for the exemplary embodiments can be applied for any wavelength regime. The geometry of meta-atoms, the selection of photo-capacitive materials, and the level of optical power depend on the wavelength regime of the intended application. Upon implementation, the linear phase shift should be added into propagation phase of electromagnetic wave through Huygens-Fresnel Principle:

$$E(r) = \frac{1}{i\lambda}\int\int_{\Sigma} E(r')\frac{\exp(ik|r-r'|)}{|r-r'|}\cos\theta\, ds' \tag{1}$$

where Σ is surface of the reflector array, r is the surface observation point, r' is the surface integration point, s' is the surface integration variable, θ is the angle between the surface normal and the direction connecting the observation and integration points on the surface, λ is the wavelength, and $k=2\pi/\lambda$ is the wavenumber of free space.

In eqn. (1), the bold characters (particularly points) represent vectors. The surface integration includes the areas of meta-atoms and the spacing in between where, depending on the area of the spacing, some absorption is required to minimize the side lobe from specular reflection. Without loss of generality the electromagnetic wave can be assumed to be normally incident on the phased array. The absorption layer between the elements is assumed to have 80% absorption, and the wavelength of the incident wave is 100 mm. Nonetheless, the exemplary methodology is scalable to any wavelength.

Figure 4:
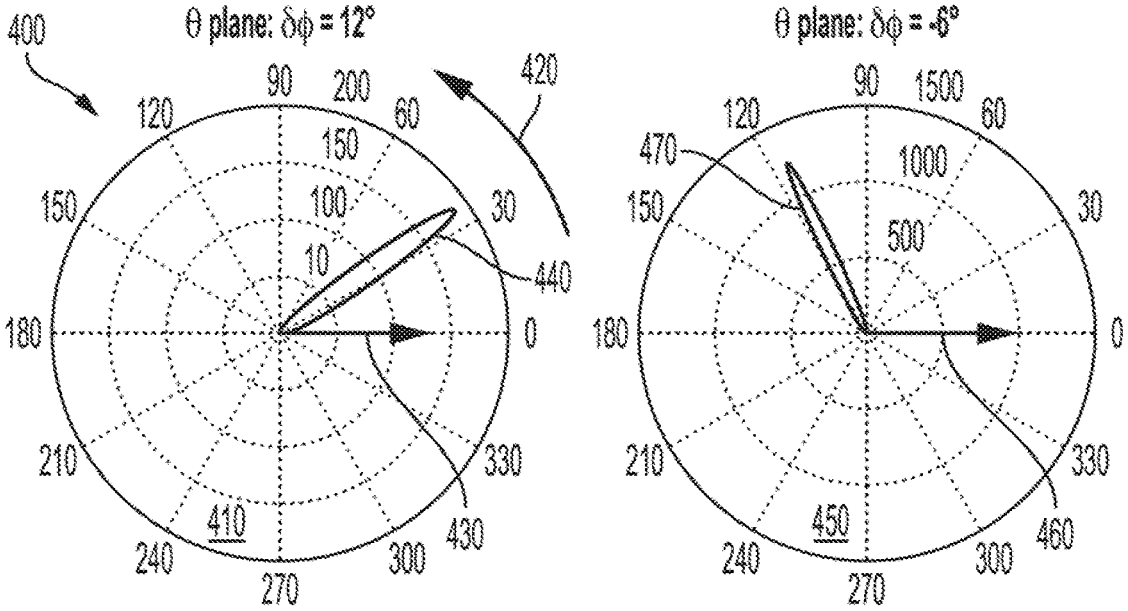
FIG. 4 is a graphical view of the direction of the reflected beam on the theta plan when a progressive phase shift across each element is 12° (left) and −6° (right)

FIG. 4 shows polar graphical views 400 showing the effect of beam steering for a one-dimensional optically controllable phased array of two-hundred meta-material elements 150 or meta-atoms. This is shown as a left polar plot 410 for a +12° phase shift of each element 150. Angular position 420 is denoted by an arc arrow marking degrees, while magnitude of the beam power position 430 is denoted by a straight arrow marking the magnitude of the beam power out to 200 arbitrary units.

The plot 410 shows a beam 440 extending radially with the maximum power 180 arbitrary units pointing to the direction of 35° angle of elevation. A right polar plot 450 provides a similar arrangement for a −6° phase shift of each element 150, with magnitude of the beam power position 460 denoted by a straight arrow marking the magnitude out to 1500 arbitrary units. The plot 450 shows a beam 470 extending radially with the maximum power 1200 arbitrary units pointing to the direction of 115° angle of elevation.

View 400 shows the direction of reflection when a beam is normally incident on a one-dimensional phased array of two-hundred elements 150. The size of the element is 3 mm and the spacing is 1 mm. Depending on the sign of the progressive phase shift along the elements, the normal incident beam can be deflected either to the left or to the right. Thus, by tuning optical power the direction of the reflected beam can be dynamically controlled. In view 400, the progressive phase shift of each element is +12° in the left plot 410 and −6° in the right plot 450, thus demonstrating the beam steering effect. When the absorption layer is replaced by a non-absorptive dielectric layer, the reflection out of the spacing between the meta-atoms 150 may contribute to another reflection beam in the direction of the specular reflection, as illustrated in FIG. 5.

Figure 5:
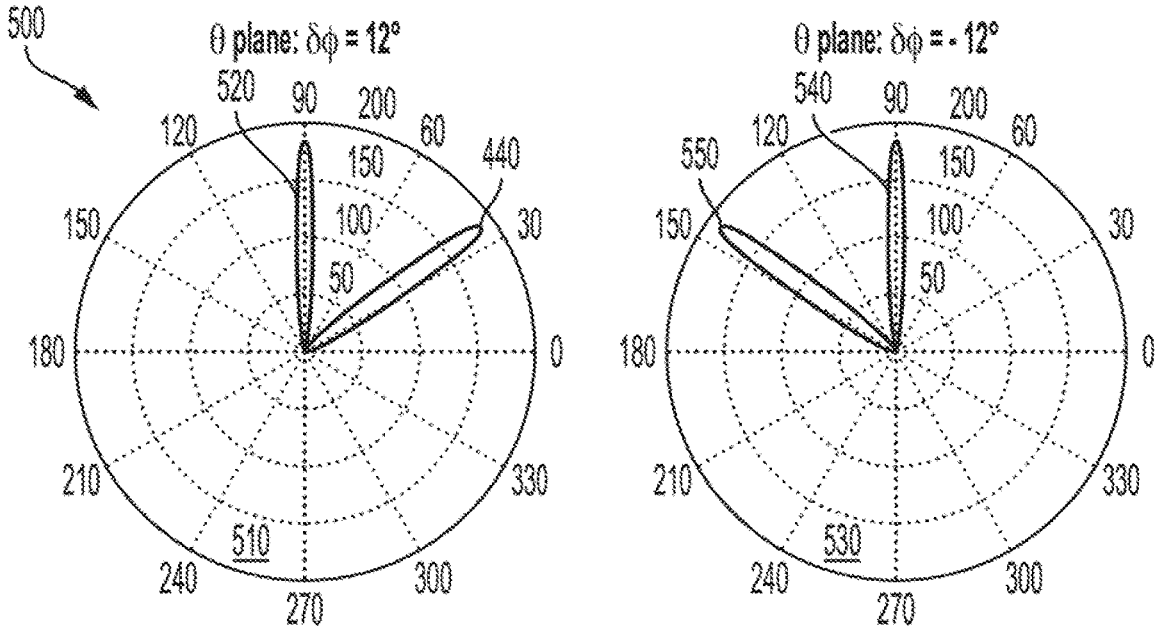
FIG. 5 is a graphical view of a two-mode operation showing the direction of the reflected beam on the theta plan when a progressive phase shift across each element is 12° (left) and −12° (right), along with the direction of the incident (or specular reflected) beam.

FIG. 5 shows polar graphical views 500 showing a two-beam mode for beam steering, revealing directions of the reflected beam. This is shown as a left polar plot 510 for a +12° phase shift of each element 150. Angular position 420 and magnitude position 430 correspond to plot 410. The plot 510 shows a reflected beam 440 pointing to the direction of 35° angle of elevation, and an normally incident (specular reflected) beam 520 in the direction of 90° angle of elevation, both extending radially with the maximum power 180 arbitrary unit. A right polar plot 530 provides a similar arrangement for a −12° phase shift, with an normally incident (specular reflected) beam 540 in the direction of 90° angle of elevation, and a reflected beam 550 pointing to the direction of 145° angle of elevation, both extending radially with the maximum power 180 arbitrary unit.

In view 500, a single beam is incident normally (90°) on the panel of the reflector array, which reflects the beam into two directions. One direction is controlled by the linear phased array. The other is the specular reflection. In this case, the absorption layer is replaced by a non-absorptive dielectric layer 130. The progressive phase shift of each element 150 is +12° in plot 510 and −12° in plot 530. All other parameters are the same as those in view 400.

This feature will be useful in a variety of applications. Artisans of ordinary skill will recognize that the design and operation details of any particular method and system for the exemplary embodiments depend on the particular application intended. Direction of the reflected beam when the beam is normally incident (90°) on a two-dimensional optically controllable phased array of 30×30 elements. The progressive phase shift of each element is +12° along the x-direction, with no phase shift in the y-direction.

Figure 6:
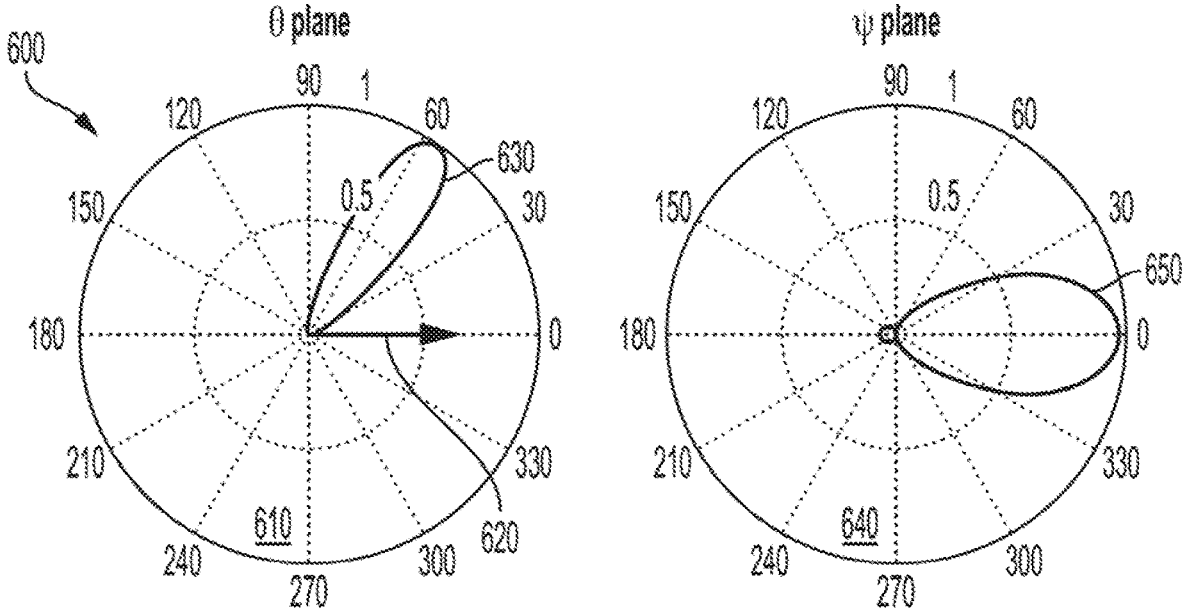
FIG. 6 is a graphical view of the direction of the reflected beam on the theta-plane (left) and the phi-plane (right).

FIG. 6 shows polar graphical views 600 showing a two-beam mode for beam steering, revealing directions of the reflected beam. This is shown as a left polar plot 610 for the θ-plane. Angular position 420 corresponds to plot 410, while magnitude of the beam power position 620 extends to one (1) unit. The plot 610 shows the beam 630 extending in the θ-plane with the maximum power 1 (arbitrary unit) pointing to the direction of 58° angle of elevation. A right polar plot 640 provides a similar arrangement for the ψ-plane (azimuth), with the wide beam 650 extending in the ψ-plane with the maximum power 1 (arbitrary unit) pointing to the east direction. The plot 610 shows the reflection pattern in the polar plane, while the plot 630 shows the reflection pattern in the azimuthal plane.

View 600 demonstrates the direction of reflection when a beam is normally incident on a two-dimensional phased array of 30×30 elements. The size of the element is 3 mm in the x-direction and 2 mm in the y-direction, while the spacing is 1 mm in the x-direction and 2 mm in the y-direction. In the two-dimensional case, the phase shift is assumed in one direction only, i.e., the x-direction in the simulation. The progressive phase shift of each element is +12° along the x-direction, whereas there is no phase shift in the y-direction. From the simulation, the progressive phase shift occurs in both directions, the dynamic range of the beam steering is reduced. Comparing the plots 410 and 610, the two-dimensional phased array reflector has a smaller beam steering range than its one-dimensional counterpart.

Exemplary embodiments can be utilized in military fields as well as in civilian; e.g., transmission of radiation with controlled direction, such as beam steering, for nonmilitary use from radio frequency to infrared frequencies, and thus would be of interest for maritime and aerial navigation, and for weather radars.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A control device for photonic switching, said device comprising:

an electrically conductive backplane;

an intermediate layer disposed on said backplane;

a light sensitive meta-material element disposed on said intermediate layer; and a light guide film disposed between said intermediate layer and said meta-material element.

2. The device according to claim 1, wherein said intermediate layer is a light absorber.

3. The device according to claim 1, wherein said intermediate layer is a dielectric material.

4. The device according to claim 1, wherein said backplane is at least one of gold, silver, copper and aluminum.

5. The device according to claim 1, wherein said meta-material element includes first and second electrically conductive patches and a photo-capacitive switch therebetween.

6. The device according to claim 5, wherein said photo-capacitive switch is composed of a meta-material.

7. A method for controlling a phase shift of an incoming electromagnetic signal in an antenna comprising:

providing a reflectarray or phased array antenna having a plurality of optically tunable metamaterial unit cells according to claim 1; and adjusting the phase shift of the electromagnetic signal by optically tuning at least some of said photo-capacitive material.

8. The method of claim 7 wherein said photo-capacitive material is optically tuned to achieve a phase change.

9. The method of claim 7 wherein said photocapacitave material is optically tuned to achieve a change in direction of said electromagnetic radiation.

* * * * *